United States Patent [19]

Galves

[11] 4,242,371

[45] Dec. 30, 1980

[54] HIGH-LUMINANCE COLOR SCREEN FOR CATHODE-RAY TUBES AND THE METHOD FOR MANUFACTURING THE SAME

[75] Inventor: Jean-Pierre Galves, Paris, France

[73] Assignee: Thomson-CSF, Paris, France

[21] Appl. No.: 959,171

[22] Filed: Nov. 9, 1978

Related U.S. Application Data

[63] Continuation of Ser. No. 808,831, Jun. 22, 1977, abandoned.

[30] Foreign Application Priority Data

Jun. 25, 1976 [FR] France ..... 76 19460

[51] Int. Cl.[2] ..... B05D 1/36; B05D 3/02; H01J 29/18

[52] U.S. Cl. ..... 427/68; 427/72; 427/73

[58] Field of Search ..... 427/68, 72, 73

[56] References Cited

U.S. PATENT DOCUMENTS

| | | | |
|---|---|---|---|
| 3,204,143 | 8/1965 | Pritchard | 313/473 X |
| 3,225,238 | 12/1965 | Feldman | 427/68 X |
| 3,231,775 | 1/1966 | Pritchard | 313/473 |
| 3,517,243 | 6/1970 | Jones | 313/473 |
| 3,603,792 | 9/1971 | Gallaro et al. | 313/473 X |
| 3,714,490 | 1/1973 | Kell | 313/473 X |
| 3,904,502 | 9/1975 | Phillips | 313/473 X |

*Primary Examiner*—James R. Hoffman
*Attorney, Agent, or Firm*—Roland Plottel

[57] ABSTRACT

The screen comprises superimposed layers of phosphor crystals having fluorescences of different colors separated by an inert layer having a substantially uniform thickness. In one example, the layers are of green phosphor P1 (J.E.D.E.C.) ($\lambda = 550$ nm) and red phosphor yttrium vanadate activated with europium ($\lambda = 610$ nm), in a proportion of 3 to 4 mg/cm$^2$ and 0.15 mg/cm$^2$ respectively. The inert layer is silicon sesquioxide ($Si_2O_3$), and has a thickness of 1.2 $\mu$m. High luminances are obtained throughout the range of colors, for operating voltages ranging between 10 kV and 17 kV.

3 Claims, 6 Drawing Figures

HIGH-LUMINANCE COLOR SCREEN FOR CATHODE-RAY TUBES AND THE METHOD FOR MANUFACTURING THE SAME

This is a continuation of application Ser. No. 808,831 filed June 22, 1977, and now abandoned.

Broadly speaking, this invention relates to a cathode-ray tube having high luminance traces the colour of which may be changed by changing the acceleration voltage for the beam. More particularly, in a preferred embodiment, this invention relates to a screen for such a cathode-ray tube and to a method for making the screen.

Luminescent screens for cathode-ray tubes, termed penetration screens, are well known in the prior art. In such tubes, the colour of the trace varies with the acceleration voltage for the electron beam. However, in such prior tubes the luminance of the traces is not bright enough to allow easy reading of the information displayed on the screen, especially in surroundings having high ambient illumination.

Now, such surroundings are frequently encountered, particularly in the case of equipment carried on aircraft. The problem that the instant invention solves is that of providing a screen which permits easy reading of information displayed on the screen, even in those surroundings having a high ambient level of light.

Cathodo-luminescent screens of this type typically comprise two phosphors of different fluorescences, for example green and red. They are diagrammatically represented as comprising two homogeneous layers, one for each of the phosphors, separated by a layer of inert or non-luminescent material, i.e. a material which emits no light under electron bombardment.

Depending on the value of the acceleration voltage V for the electron beam, that is to say, depending on the energy of the electrons in the beam, only the first of these layers, for example, the red phosphor, undergoes excitation by the beam. Or if the beam has sufficient energy the red phosphor and all or part of the second, green phosphor will be excited. The green phosphor begins to be excited when the acceleration voltage exceeds a certain value, namely that valve which corresponds to sufficient electron energy to enable the beam to penetrate the screen—whence comes the designation "penetration screen"—to impinge upon the layer of green phosphor after having passed through the layer of red phosphor and the inert layer. This value of the acceleration voltage will be designated hereinafter as $V_0$. For a sufficiently high value $V_1$ of the voltage V, beyond $V_0$, the green fluorescence is predominant and the trace takes on a green colour. Between $V_0$ and $V_1$ one obtains, depending on the particular value of V, colours which fall between green and red, depending upon the proportions of the two excited phosphors in the trace.

Various penetration screen structures are known in the prior art. For example, one screen comprises a layer of red and green phosphors material separated by a layer of inert material, all the layers being thin films obtained by evaporation under a vacuum. (See, for example, U.S. Pat. No. 3,225,238 to Feldman). Unfortunately, this type of screen exhibits extremely weak luminance which is caused by the fact that radiation emitted within the films experiences multiple reflections within the films.

Another known structure comprises a mixture of red and green phosphor crystals, the green crystals having been coated due to mixing with a film of inert material. Such mixtures usually provide a luminance which is substantially higher than that provided by the preceding structure.

In a third prior art structure (See, for example, U.S. Pat. No. 3,714,490), the red phosphor is in the form of small particles surrounding the inert layer covering the larger green particles. In this arrangement, the luminance of the red phosphor is substantially improved, but the problem to be solved is an increase in the overall luminance of the screen, that is to say, all the traces and not only that given off by the red phosphor. In other words, as the luminance of the red phosphor is increased, the luminance of the green phosphor must also be increased in the same proportion, since it is this proportion that determines the range of hues that is obtained as the electron voltage is increased beyond the minimum value required for excitation of the green phosphor, that is to say, $V_0$. It is clearly desirable to be able to employ this entire range for viewing of information and the range would be restricted if the increase in the luminance of the red phosphor were not accompanied by a corresponding increase for the green phosphor.

An object of the invention, then, is to provide a method for manufacturing the structure.

The screen of the invention comprises two superimposed layers of phosphor crystals each having a fluorescence of different colour separated by a planar layer of an inert material of uniform thickness.

A better understanding of the invention will be had with reference to the ensuing description and the accompanying figures in which:

DETAILED DESCRIPTION OF THE INVENTION

Figure 1:
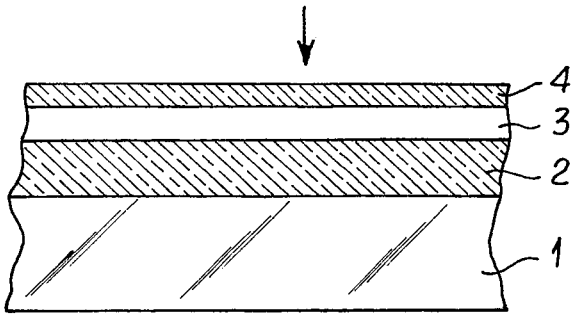
FIG.1 PRIOR ART
FIGS. 1, 2, 3: are diagrammatic, sectional views of fragments of penetration screens of the prior art.

In all the figures, the same reference numerals designate the same elements, certain crosshatchings have been omitted for reasons of clarity, for the same reasons of clarity the proportions of the different elements have not been respected; and the arrow gives the direction of the electron beam.

FIG. 1 shows a fragment of a prior art penetration screen. In FIG. 1 there is seen, on a transparent glass support or substrate 1, a layer of a green phosphor 2 covered with a layer of an inert material 3 comprising silica, itself covered with a layer of red luminiphore 4; all these transparent layers being obtained by evaporation under vacuum of their constituent material, are very thin.

Figure 2:
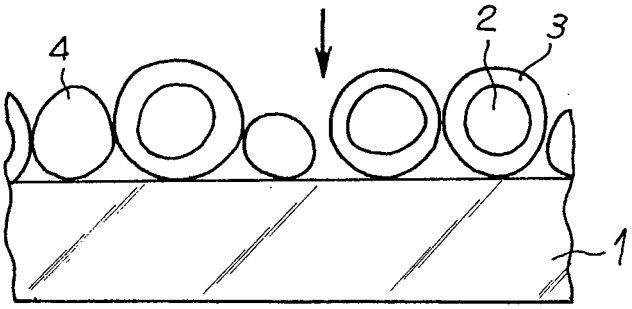
FIG.2 PRIOR ART

In FIG. 2, which represents another prior art structure, the same elements are found as in FIG. 1, but whereas in the embodiment of FIG. 1, the phosphors are disposed in continuous layers, in the embodiment of FIG. 2 they are mixed, the crystals of the two phosphors alternating with each other, as shown in the figure. As shown, these crystals have an approximately spherical shape and this arrangement ensures a substantial improvement in the luminance of the screen with respect to the preceding example.

Figure 3:
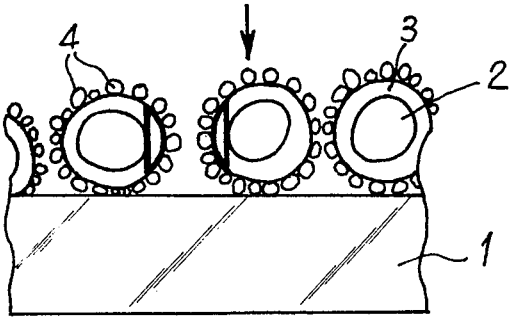
FIG.3 PRIOR ART

FIG. 3 shows yet another prior art embodiment of a screen having two phosphors. In this example, the crystals of the red phosphor adhere to the layer of inert material save a few interstices.

Figure 4:
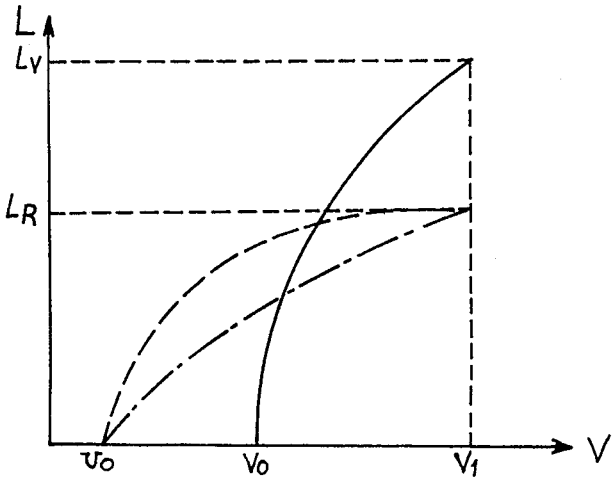
FIGS. 4 and 6: are explanatory diagrams useful in understanding operation of the screen shown in FIG. 5.

This arrangement results in a still further improvement in lu-inance which will be seen from the diagram of FIG. 4. The graph of FIG. 4 represents the increase in luminance as a function of the acceleration voltage V, for each of the phosphors, when changing from the structure of FIG. 2 to that of FIG. 3. In FIG. 4 the logarithms of the luminances are plotted as ordinates in accordance with the practice for this type of representation. Drawn in dot-dash line, and in dashed line, are respectively the curves for the red phosphor of the second and third embodiments; the curve in dashed line is completely above that of the dot-dash line; this indicates a higher red luminance due to the dissemination of the crystals of the red phosphor throughout the surface of the screen in the case of the structure of FIG. 3. With respect to the voltage $V_0$ in the red phosphor, the luminance $LR_3$ is higher than the luminance $LR_2$.

The curve in full line is that of the green phosphor whose luminance, LV hereinafter, at voltage $V_1$, much higher than that of the red, corresponds to a trace on the screen which is saturated with green. It had been supposed that this curve was the same in the two embodiments; i.e. to obtain the same colour at voltage $V_1$, the red phosphors must have the same luminance LR in both cases. This comparison shows that, in changing from one structure to the other, namely from that of FIG. 2 to that of FIG. 3, the luminance of the green phosphor can be increased without increasing that of the green phosphor. To obtain the same colour components, or the same colour at voltage $V_1$, the luminance of the green phosphor must be increased in the same proportion as that of the red phosphor in order to maintain the ratio LV/LR constant.

Moreover, it will be observed that, even in the arrangement of FIG. 3, part of the electron beam may pass through the inert layer and practically the whole of the luminescent layer of the screen without ever encountering the green phosphor. These electrons are those in that part of the beam which strikes the screen in the interval between two adjacent green crystals 2, and principally in all of the portion of the red crystals within the space limited to one of the contours in thick line in FIG. 3. Everything occurs therefore as if in certain regions the inert layer were much thicker than it really is.

Figure 5:
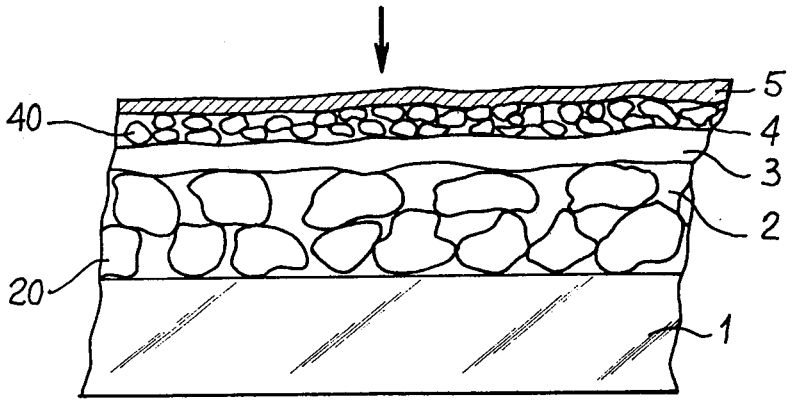
FIG. 5 is a similar view of a screen according to the invention.

In order to make the thickness of this layer uniform, the invention provides a structure having superimposed green and red phosphor layers separated by a planar inert layer having a thickness which is as constant as possible. This structure is shown in FIG. 5 and is in a form similar to that of FIG. 1. But, contrary to the latter, each of the layers of phosphor is comprised of large crystals 20 and 40, respectively, which are not present in the thin transparent films found in FIG. 1. There is practically no absorption by reflection within the crystals used in FIG. 5.

Figure 6:
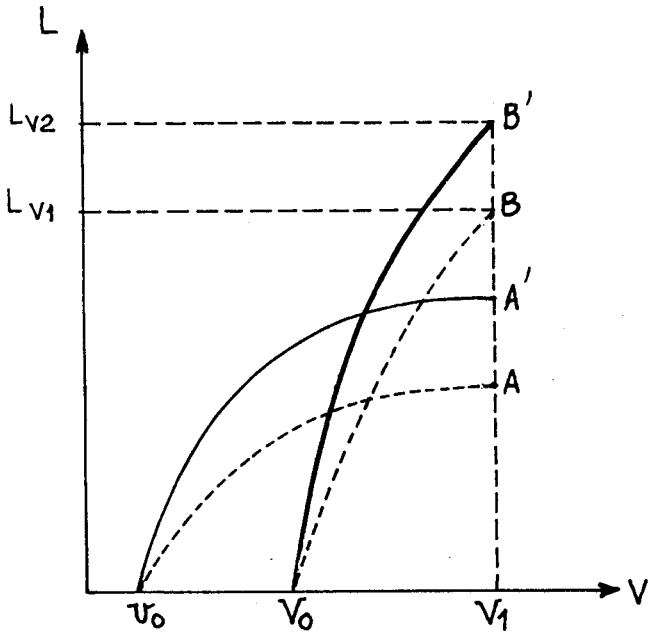

The diagram of FIG. 6 shows the improvement in the luminance of the green phosphor over the prior art structure shown in FIG. 3. As can be seen, the two corresponding curves are those leading from the abscissa point $V_0$.

The dotted line represents the prior art and the full line represents the instant invention.

This increase in luminance in the high voltage, or green mode, corresponds to the length $LV_1LV_2$ in the logarithmic scale. This arrangement permits the luminance of the red phosphor to be increased while retaining the same colour point at voltage $V_1$.

This increase must be such that, at voltage $V_1$, the ratio between the luminance of the green phosphor and the red phosphor is maintained. That is to say, the size of segment AB of the chosen logarithmic scale, must be maintained. Additionally, the increase in the luminance of the red phosphor must occur in a ratio which is identical to that of the luminance of the green phosphor. The two luminance curves of the red phosphor, leading from the absicca point $V_0$, are represented in the diagram of FIG. 6 in dotted line and in full line for the preceding prior art example and for the invention, respectively. It can be seen that, in the red operating mode at the operating voltage $V_0$, the luminance of the red phosphor has also increased roughly in the same proportions. At the voltage $V_1$, AB substantially equals A'B'. In FIG. 5 the references 20 and 40 designate the constituent crystals of the green and red layers 2 and 4 respectively, 5 is a conductive thin layer, usually of aluminum, which covers all of these screens (but not shown in the preceding examples) and ensures the return of the charges.

The above-described screens may be produced in a manner which will now be described.

First, there is deposited on a thick glass support 1 a layer of green phosphor powder (for example, phosphor type P1 of the J.E.D.E.C. specification published by "Electronic Industries Association") in accordance with any of several known methods, for example, sedimentation. The powder advantageously has a particle size of about 6 micro-meters, and the amount deposited is from 3 to 4 milligrams per square centimeter.

Next, there is then deposited a layer of inert material 3, for example zinc sulphide, magnesium fluoride, or silicon sesquioxide $Si_2O_3$, obtained by evaporation under an atmosphere having a low pressure of oxygen. It is necessary for good operation that this inert layer have planar faces and a thickness which is as constant as possible. This would not be the case if the inert layer were merely evaporated on to the preceding layer of green phosphor. This is why according to the invention two stages are employed, namely: First, producing, by any known means, on the layer of green phosphor a film of organic material which acts as a temporary support for the inert layer. A polymer, such as butyl metacrylate, is suitable for this organic film; Second, evaporating on the organic material the desired film of inert material at a thickness which depends on the operating voltages of the tubel For a voltage $V_0$ of 10 kV, for example, this thickness is of the order of 1.2 μm if $Si_2O_3$ is used for the inert material.

The temporary organic film is eliminated by subsequent heat treatments to which the cathode-ray tube is subjected.

Next, there is then eposited on the film of inert material 3, a layer of red phosphor 4 comprised of a powder having a particle size substantially finer than that used in layer 2, namely about 0.6 μm. This powder may be way of example be one of the following materials: yttrium vanadate, an yttrium oxysulphide or a gadalinium oxide doped with europium.

This deposit is made either by centrifugation, the support rotating about a axis parallel to its plane, or by fixing the screen to a whirler, the axis of which coincides with that of the screen. Again the deposited thickness depends on the voltages of operation of the tube. For a voltage $V_0$ of 10 kV and a layer of inert material having a thickness of 1.2 $\mu$m, the layer of red phosphor will be 0.15 mg/cm$^2$. Thereafter, the aluminium film is deposited which is connected, in operation, to the high voltage supply for the tube. The screen, thus constructed, operates with a high voltage $V_1$ of 17 kV. Corresponding to these voltages of 10 kV and 17 kV are the colours of the red and green traces of 610 nanometers and 550 manometers wavelength, respectively.

The luminances obtained with the above described screen are about two and a half times greater than that obtained with screens having a mixture of phosphors according to FIG. 3.

Of course, the invention is not limited to the embodiments described and shown, which are given solely by way of example.

I claim:

1. A method of producing luminescent screens for cathode ray tubes having two layers of phosphors separated by a layer of inert material that does not emit light under the impact of electrons comprising the steps of:

(a) depositing on a transparent glass support member, a first layer of phosphor crystals;

(b) depositing on said first phosphor layer a temporary layer of organic material;

(c) depositing on said temporary organic layer a layer of inert material;

(d) depositing on said inert layer a second layer of phosphor crystals; and then (e) heating in vacuum said screen to burn off said temporary organic layer; and (f) depositing a conductive thin layer on said second phosphor.

2. The method according to claim 1 wherein the first phosphor layer comprises J.E.D.E.C. phosphor p1, and has a particle size of about 6 micrometers; and the second phosphor layer comprises yttrium vanadate doped with europium and has a particle size of about 0.6 micrometer; and said layers have thicknesses substantially corresponding to respective weights of 3 and 0.15 milligrams per square centimeter; and wherein said layer of inert material comprises silicon sesquioxide, $Si_2O_3$, and has substantially a thickness of 1.2 micrometers.

3. The method according to claim 1, wherein:

the first layer of phosphor crystals is deposited by sedimentation on the transparent glass support member;

the temporary layer of organic material deposited on said temporary organic layer is constituted of butyl methacrylate;

the layer of inert material deposited on said temporary organic layer is constituted of silicon sesquioxide $Si_2O_3$; and the second layer of phosphor crystals is deposited on said inert layer by centrifuging.

* * * * *